US011472194B2

(12) United States Patent
Sekiguchi et al.

(10) Patent No.: US 11,472,194 B2
(45) Date of Patent: Oct. 18, 2022

(54) LIQUID DISCHARGING DEVICE

(71) Applicant: Ricoh Company, Ltd., Tokyo (JP)

(72) Inventors: Satoyuki Sekiguchi, Kanagawa (JP); Toshiyuki Kobashi, Kanagawa (JP); Taku Hatakeyama, Kanagawa (JP); Takashi Watanabe, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/272,586

(22) PCT Filed: Aug. 29, 2019

(86) PCT No.: PCT/JP2019/033912
§ 371 (c)(1),
(2) Date: Mar. 1, 2021

(87) PCT Pub. No.: WO2020/050126
PCT Pub. Date: Mar. 12, 2020

(65) Prior Publication Data

US 2021/0316556 A1 Oct. 14, 2021

(30) Foreign Application Priority Data

Sep. 3, 2018 (JP) ..... JP2018-164323
Jun. 7, 2019 (JP) ..... JP2019-107142

(51) Int. Cl.
*B41J 2/19* (2006.01)
*B41J 2/175* (2006.01)

(52) U.S. Cl.
CPC ..... *B41J 2/19* (2013.01); *B41J 2/175* (2013.01)

(58) Field of Classification Search
CPC ... B41J 2/175; B41J 29/377; B41J 2/19; B41J 2/2114; B41J 2/1714; B41J 11/0015; B41J 3/4078; D06P 5/30; D06P 5/002
See application file for complete search history.

(56) References Cited

U.S. PATENT DOCUMENTS 9,649,858 B2 * 5/2017 Suzuki ..... B41J 29/13
9,873,812 B2 * 1/2018 Sarkisian ..... C09D 11/40
(Continued)

FOREIGN PATENT DOCUMENTS

CN 101767489 A 7/2010
CN 104470726 A 3/2015
(Continued)

OTHER PUBLICATIONS

Office Action dated Jan. 13, 2022 in Chinese Patent Application No. 201980054975.3, 8 pages.
(Continued)

*Primary Examiner* — An H Do
(74) *Attorney, Agent, or Firm* — Xsensus LLP

(57) ABSTRACT

A liquid discharging device is provided that includes: a first head (11) containing a pretreatment liquid, configured to discharge the pretreatment liquid onto a recording medium; a second head (12) disposed downstream of the first head (11) in a conveyance direction of the recording medium, configured to discharge an ink; an exhaust unit (14) disposed upstream of the first head (11) in the conveyance direction, configured to evacuate a gas present between the first head (11) and the recording medium from a downstream side to an upstream side in the conveyance direction; and a housing (30) internally containing the first head (11) and the second head (12), internally or externally containing the exhaust unit (14), and having an opening (32) downstream of the exhaust unit (14) in the conveyance direction.

10 Claims, 14 Drawing Sheets

(56) References Cited

U.S. PATENT DOCUMENTS

| | | | |
|---|---|---|---|
| 2003/0043230 | A1 | 3/2003 | Koitabashi et al. |
| 2006/0055730 | A1 | 3/2006 | Ono et al. |
| 2010/0149297 | A1 | 6/2010 | Kanada |
| 2011/0227999 | A1 | 9/2011 | Tachibana |
| 2013/0235121 | A1 | 9/2013 | Gras et al. |
| 2013/0271527 | A1 | 10/2013 | Shimizu |
| 2014/0176634 | A1 | 6/2014 | Rimai et al. |
| 2015/0054885 | A1 | 2/2015 | Sugiyama |
| 2015/0210094 | A1 | 7/2015 | Komiya |
| 2015/0283828 | A1 | 10/2015 | Aoai et al. |
| 2017/0232746 | A1 | 8/2017 | Nishida |
| 2017/0341399 | A1 | 11/2017 | Arimizu et al. |
| 2018/0001648 | A1 | 1/2018 | Kearns et al. |
| 2018/0059585 | A1 | 3/2018 | Kuroda et al. |
| 2018/0162148 | A1 | 6/2018 | Komiya |

FOREIGN PATENT DOCUMENTS

| | | | |
|---|---|---|---|
| CN | 107443907 | A | 12/2017 |
| CN | 107783400 | A | 3/2018 |
| JP | 7-025007 | A | 1/1995 |
| JP | 2003-200565 | A | 7/2003 |
| JP | 2005-088459 | A | 4/2005 |
| JP | 2006-088468 | A | 4/2006 |
| JP | 2007-021906 | A | 2/2007 |
| JP | 2007-230034 | A | 9/2007 |
| JP | 2008-213310 | A | 9/2008 |
| JP | 2011-088103 | A | 5/2011 |
| JP | 2012-007148 | A | 1/2012 |
| JP | 2013-233792 | A | 11/2013 |
| JP | 2014-136321 | A | 7/2014 |
| JP | 2015-136865 | A | 7/2015 |

OTHER PUBLICATIONS

International Search Report and Written Opinion dated Nov. 19, 2019 in PCT/JP2019/033912 filed on Aug. 29, 2019.

CS&E—Upload peer contribution by EPO on Oct. 25, 2019. in PCT/JP2019/033912 filed on Aug. 29, 2019.

CS&E—Upload peer contribution by CNIPA on Oct. 25, 2019. in PCT/JP2019/033912 filed on Aug. 29, 2019.

CS&E—Upload peer contribution by KIPO on Nov. 4, 2019. in PCT/JP2019/033912 filed on Aug. 29, 2019.

CS&E—Upload peer contribution by USPTO on Oct. 17, 2019. in PCT/JP2019/033912 filed on Aug. 29, 2019.

Office Action dated Apr. 21, 2022 in European Patent Application No. 19858086.2, 8 pages.

* cited by examiner

LIQUID DISCHARGING DEVICE

TECHNICAL FIELD

The present disclosure relates to a liquid discharging device.

BACKGROUND ART

In recent years, the market of direct to garment (DTG) printing, which is a technology for direct printing on clothes such as T-shirts, has been expanding year by year. As demand for sportswear is rapidly increasing, DTG printing technology is required to be applicable to polyester media in addition to conventional cotton or cotton-polyester mixed media. Such a trend is recognized not only in the field of DTG printing but also in the whole field of textile printing. Even in an inkjet printer equipped with a winding-unwinding mechanism, there is an increasing demand for inkjet recording systems capable of forming images with excellent color developing property and various fastnesses on fabrics of various materials including cotton and polyester.

Patent Document 1 proposes an ink set for producing a print having high color developing property and less blurring. This ink set contains a pretreatment liquid containing a polyvalent metal ion and a first polymer particle and further contains an ink containing a second polymer particle. Both the first polymer particle and the second polymer particle comprise a cross-linkable polyurethane and/or a cross-linkable polyurethane-polyurea.

In attempting to reduce adhesion of liquid mist to a belt cleaner provided between recording heads, Patent Document 2 proposes provision of a partition which blocks between the recording heads and the belt cleaner.

CITATION LIST

Patent Literature

PTL 1: Unexamined Japanese Patent Application Publication No. 2012-7418
PTL 2: Japanese Patent No. 4222606

SUMMARY OF INVENTION

Technical Problem

However, even if the ink set of Patent Document 1 improves color developing property, discharge reliability is poor because mist generated from a pretreatment liquid discharging head adheres to a nozzle-formed surface of an inkjet head to cause aggregation of the ink.

On the other hand, in the image forming apparatus of Patent Document 2, the partition provided between the heads provides an effect of preventing the mist from coming into contact with the nozzle-formed surface of the ink head. However, the effect is insufficient in the case of discharging a pretreatment liquid from the head. More specifically, in the case of providing a head for discharging the pretreatment liquid, nozzle clogging or deposit on the nozzle surface is caused upon contact with the pretreatment liquid, even when the amount thereof is very smaller than the conventional ink, thereby causing defects such as curved jetting. Therefore, the effect of preventing contact with the mist, provided by the partition, is insufficient.

In view of the above-described situation, an object of the present invention is to provide a liquid discharging device that exhibits excellent discharge reliability onto various recording media such as coated papers, plastic films, and fabrics and discharges a liquid capable of providing an image with excellent color developing property.

Solution to Problem

To solve the above-described problems, an embodiment of the present invention provides a liquid discharging device including: a first head containing a pretreatment liquid, configured to discharge the pretreatment liquid onto a recording medium; a second head disposed downstream of the first head in a conveyance direction of the recording medium, configured to discharge an ink; an exhaust unit disposed upstream of the first head in the conveyance direction, configured to evacuate a gas present between the first head and the recording medium from a downstream side to an upstream side in the conveyance direction; and a housing internally containing the first head and the second head, internally or externally containing the exhaust unit, and having an opening downstream of the exhaust unit in the conveyance direction.

Advantageous Effects of Invention

According to an embodiment of the present invention, a liquid discharging device is provided that exhibits excellent discharge reliability onto various recording media such as coated papers, plastic films, and fabrics and discharges a liquid capable of providing an image with excellent color developing property.

BRIEF DESCRIPTION OF DRAWINGS

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF EMBODIMENTS

Figure 1:
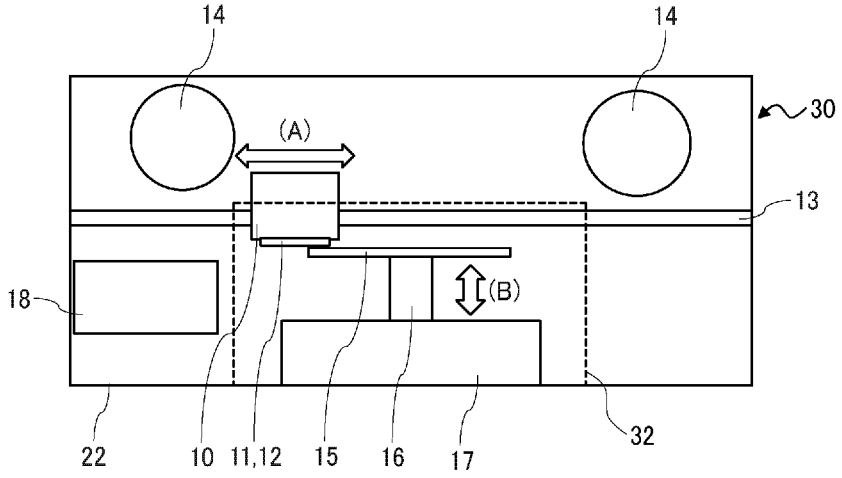
FIG. 1 is a schematic cross-sectional view of a liquid discharging device according to a first embodiment, in the direction perpendicular to a conveyance direction.

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, the liquid discharging device according to some embodiments of the present invention is described with reference to the drawings. Incidentally, it is to be noted that the following embodiments are not limiting the present invention and any deletion, addition, modification, change, etc. can be made within a scope in which person skilled in the art can conceive including other embodiments, and any of which is included within the scope of the present invention as long as the effect and feature of the present invention are demonstrated.

First Embodiment

The liquid discharging device according to an embodiment of the present invention is described below.

The liquid discharging device according to an embodiment of the present invention includes: a first head containing a pretreatment liquid, configured to discharge the pretreatment liquid onto a recording medium; a second head disposed downstream of the first head in a conveyance direction of the recording medium, configured to discharge an ink; an exhaust unit disposed upstream of the first head in the conveyance direction, configured to evacuate a gas present between the first head and the recording medium from a downstream side to an upstream side in the conveyance direction; and a housing internally containing the first head and the second head, internally or externally containing the exhaust unit, and having an opening downstream of the exhaust unit in the conveyance direction.

A preferred embodiment of the liquid discharging device includes an image forming apparatus.

The liquid discharging device according to the present embodiment is illustrated in FIG. 1. In FIG. 1, a recording medium is conveyed in the direction perpendicular to the surface of the paper on which FIG. 1 is drawn. FIG. 1 is a schematic cross-sectional view of the liquid discharging device in the direction perpendicular to the conveyance direction of the recording medium.

Referring to FIG. 1, the liquid discharging device includes a carriage 10, a first head 11, a second head 12, a carriage scanning rail 13, an exhaust unit 14, a platen 15, a support 16, a platen moving table 17, a maintenance unit 18, a housing 30, and an opening 32.

The platen 15 is configured to hold a recording medium, and the size and the like thereof can be changed as appropriate.

The recording medium is not particularly limited. Examples thereof include, but are not limited to, coated papers, plastic films, and fabrics, and in addition, clothes such as T-shirts and papers.

The platen 15 is supported by the support 16.

The platen moving table 17 is a mechanism for moving the platen 15. The platen moving table 17 is configured to move the platen 15 in the vertical direction (indicated by arrow (B) in the drawings) and also in the conveyance direction of the recording medium.

The maintenance unit 18 is a mechanism for performing maintenance of the head. The maintenance unit 18 includes a cap, a suction pump, and an dummy discharge receptacle.

Hereinafter, in the case of describing the first head 11 and the second head 12 without distinction, they may be simply referred to as the head.

The carriage 10 is a housing containing the first head 11 and the second head 12. The carriage 10 is further equipped with an encoder sensor, a moving belt, and an elevating mechanism.

The carriage scanning rail 13 is a rail for moving the carriage 10 in the direction perpendicular to the conveyance direction of the recording medium.

The direction perpendicular to the conveyance direction of the recording medium may also be referred to as the main scanning direction. The main scanning direction is indicated by arrow (A) in the drawings. The conveyance direction of the recording medium may also be referred to as the sub-scanning direction. The main scanning direction and the sub-scanning direction are orthogonal to each other.

The first head 11 is a head for discharging a pretreatment liquid. The second head 12 is a head for discharging an ink. Hereinafter, in the case of describing the first head 11 and the second head 12 without distinction, they may be simply referred to as the head.

The exhaust unit 14 is a mechanism for evacuating a gas present in a device main body 22 to the outside of the device main body 22. The exhaust unit 14 may have a fan. The fan may be connected to a motor.

The housing 30 internally contains the first head 11 and the second head 12, internally or externally contains the exhaust unit 14, and has the opening 32 downstream of the exhaust unit 14 in the conveyance direction of the recording medium. The opening 32 allows a gas to flow into the housing 30 from the opening 32, and the gas is guided to the exhaust unit 14. This configuration makes it possible to create a gas flow as described later.

The size, material, and shape of the housing 30 are not particularly limited and can be changed as appropriate. The opening 32 is indicated by broken lines in the drawings for the purpose of illustration and not for limiting. The position and size thereof can be changed as appropriate.

In the present embodiment, the exhaust unit 14 is provided outside the housing 30 and in contact with the housing 30, but the configuration is not limited thereto.

Figure 2:
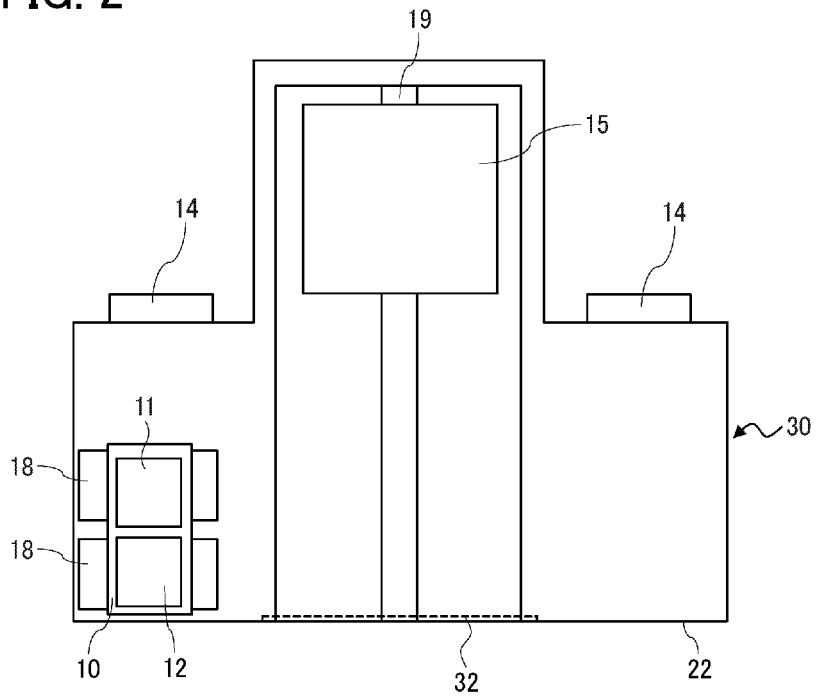
FIG. 2 is a schematic plan view of the liquid discharging device according to the first embodiment.

FIG. 2 is a schematic plan view of the liquid discharging device according to the present embodiment in a state before movement of the carriage 10 and the platen 15.

As illustrated, the carriage 10 is provided with the first head 11 and the second head 12. In FIG. 2, the carriage scanning rail 13 is omitted.

The platen 15 moves along a platen moving rail 19.

The opening 32, indicated by broken lines, is provided on a surface of the housing 30 which faces the exhaust unit 14.

Figure 3:
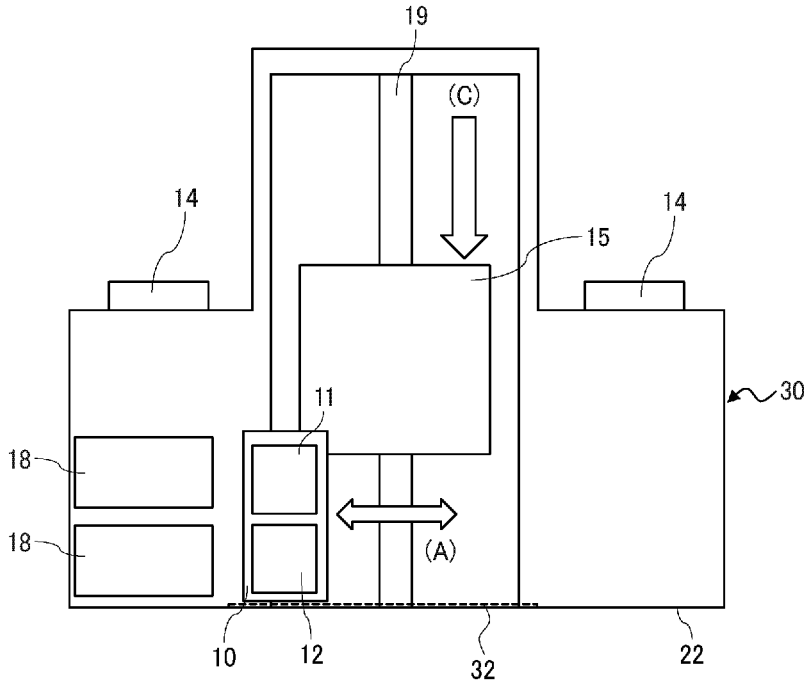
FIG. 3 is another schematic plan view of the liquid discharging device according to the first embodiment.

FIG. 3 is another schematic plan view of the liquid discharging device according to the present embodiment in a state after the carriage 10 and the platen 15 illustrated in FIG. 2 have moved.

As illustrated, the platen 15 moves along the platen moving rail 19 in the direction indicated by arrow (C) in the drawings. Since the recording medium is moved held on the platen 15, the moving direction of the platen 15 coincides with the conveyance direction of the recording medium.

As illustrated, the second head 12 is disposed downstream of the first head 11 in the conveyance direction of the recording medium.

As the platen 15 moves in the direction indicated by arrow (C) in the drawings and approaches the carriage 10, the carriage 10 discharges liquids from the heads while scanning in the main scanning direction (indicated by arrow (A) in the drawings). At this time, the first head 11 discharges the pretreatment liquid toward the recording medium first, and the second head 12 thereafter discharges the ink toward the recording medium.

Figure 4:
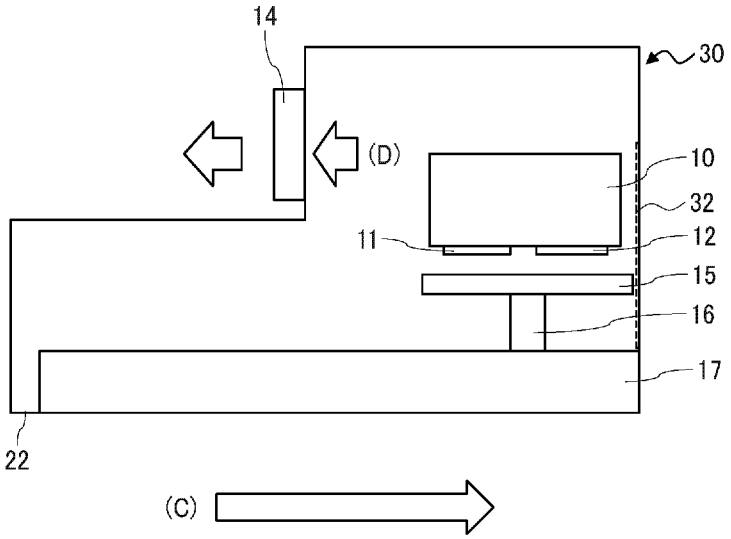
FIG. 4 is a schematic side view of the liquid discharging device according to the first embodiment.
Figure 5:
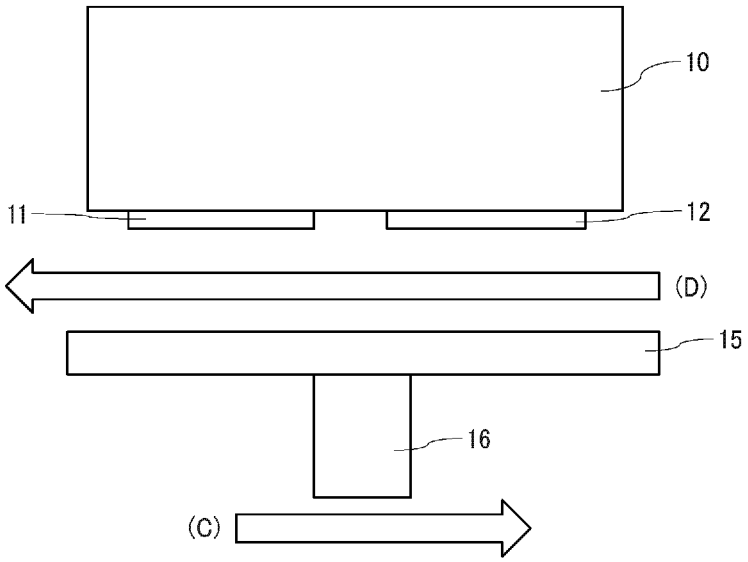
FIG. 5 is another schematic side view of the liquid discharging device according to the first embodiment.

FIG. 4 is a schematic side view of the liquid discharging device according to the present embodiment. FIG. 5 is an enlarged schematic view of a major part of FIG. 4.

In the present embodiment, the exhaust unit 14 is disposed so that the gas present between the first head 11 and the recording medium (or the platen 15) flows upstream in the conveyance direction of the recording medium. Further, as indicated by arrow (D) in FIG. 4, the gas inside the device main body 22 is evacuated (in other words, "emitted", "discharged", "moved", or "sucked") outside.

Thus, as illustrated in FIG. 5, the direction of gas flow in the space between the platen 15 and each head coincides with the direction from the second head 12 toward the first head 11 (indicated by arrow (D) in FIG. 5). In other words, the gas present between the first head 11 and the platen 15 flows upstream in the conveyance direction of the recording medium.

As a result, mist of the pretreatment liquid generated in the vicinity of the first head 11 hardly reaches the second head 12, preventing aggregation of the ink. As aggregation of the ink is prevented, discharge reliability is improved.

In addition, the gas in the space between the second head 12 and the platen 15 may also flow upstream in the conveyance direction of the recording medium, as illustrated in FIG. 5.

Figure 6:
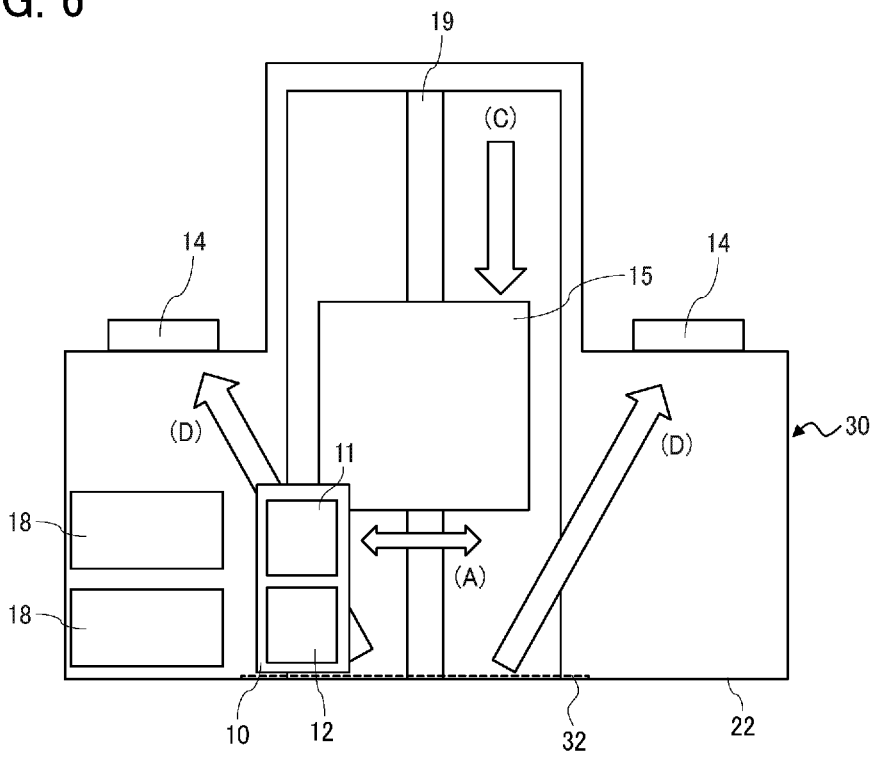
FIG. 6 is another schematic plan view of the liquid discharging device according to the first embodiment.

FIG. 6 is another schematic plan view of the liquid discharging device according to the present embodiment. FIG. 6 is the same as FIG. 3 except for illustrating arrows (D) indicating the direction of gas flow.

As illustrated, the liquid discharging device according to the present embodiment is provided with a plurality of exhaust units 14. In the present embodiment, all of the exhaust units 14 are disposed upstream of the first head 11 in the conveyance direction of the recording medium (indicated by arrow (C) in the drawings).

By this configuration, as the gas flows into the housing 30 from the opening 32 and is guided to the exhaust unit 14, the direction of gas evacuation is directed upstream in the conveyance direction of the recording medium, thus exerting the above-described effect.

Another configuration is also possible in which the position of the recording medium is fixed and the carriage is conveyed upstream and downstream. In this case, "the upstream side and the downstream side in the conveyance direction of the recording medium" can be defined by the conveyance direction relative to the head. Specifically, the upstream side in the conveyance direction of the recording medium corresponds to the downstream side in the conveyance direction of the head, and the downstream side in the conveyance direction of the recording medium corresponds to the upstream side in the conveyance direction of the head.

COMPARATIVE EXAMPLE

Figure 13:
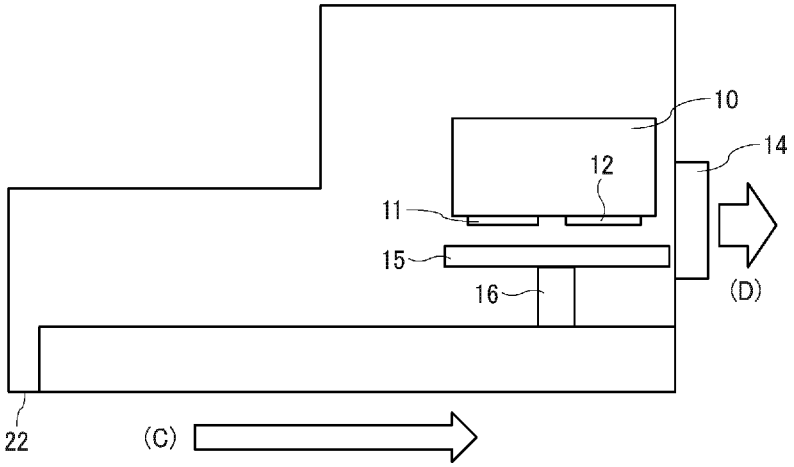
FIG. 13 is a schematic side view of a comparative example.
Figure 14:
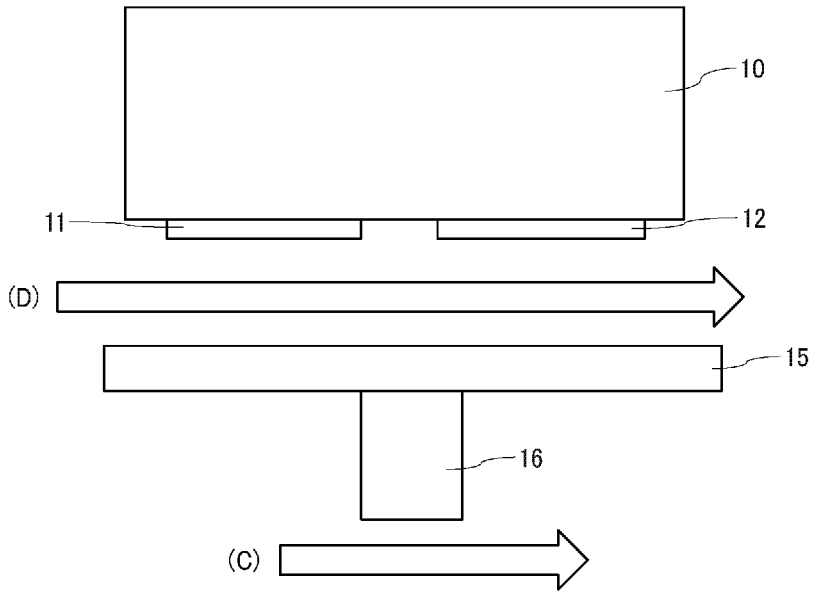
FIG. 14 is another schematic side view of the comparative example.

A comparative example not included in the scope of the present invention is illustrated in FIGS. 13 and 14. FIG. 13 is a schematic side view of an image forming apparatus according to a comparative example. FIG. 14 is an enlarged schematic view of a major part of FIG. 13.

In this example, the exhaust unit 14 is disposed downstream of the head in the conveyance direction of the recording medium. In this case, as illustrated in FIG. 14, the direction of gas flows coincides with the direction from the first head 11 toward the second head 12. As a result, mist of the pretreatment liquid easily adheres to the second head 12 to cause aggregation of the ink.

Thus, the inventive effect cannot be achieved even with provision of the opening 32 either an upstream side or a downstream side in the conveyance direction.

Second Embodiment

Next, a liquid discharging device according to another embodiment of the present invention is described below.

Descriptions of matters in common with the above embodiment will be omitted.

Figure 7:
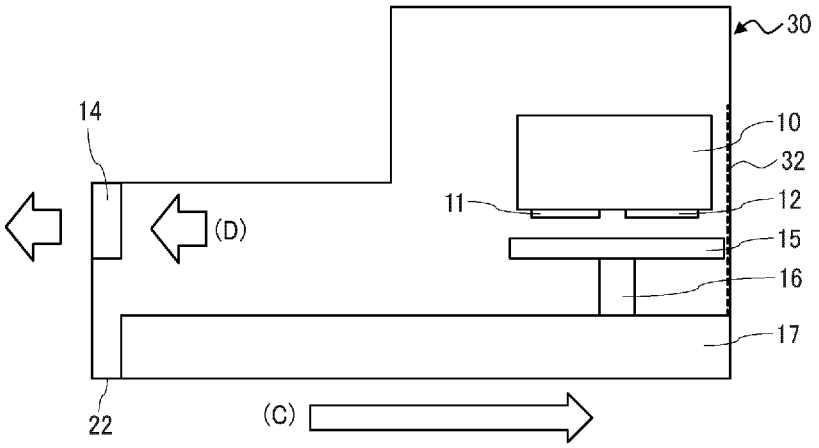
FIG. 7 is a schematic side view of the liquid discharging device according to a second embodiment.

FIG. 7 is a schematic side view of the liquid discharging device according to the present embodiment. The liquid discharging device according to the present embodiment is different from that according to the above-described embodiment in arrangement of the exhaust unit 14.

In the present disclosure, the arrangement of the exhaust unit 14 is not particularly limited and can be changed as appropriate. For example, as in the present embodiment, the exhaust unit 14 may be disposed at the end of the movement range of the platen 15.

Figure 8:
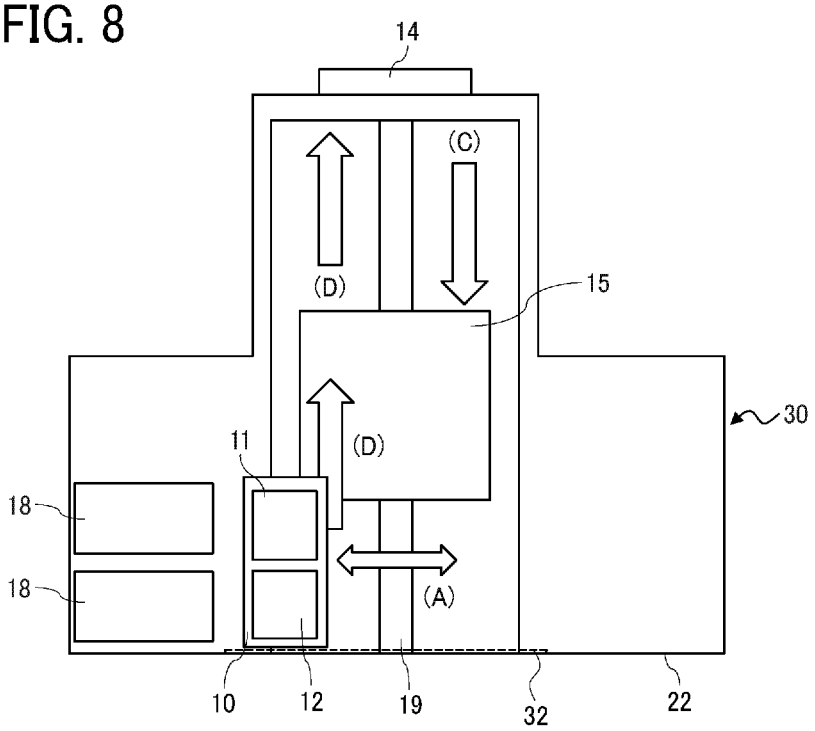
FIG. 8 is a schematic plan view of the liquid discharging device according to the second embodiment.

FIG. 8 is a schematic plan view of the liquid discharging device according to the present embodiment. The direction (D) of gas flow is opposite to the conveyance direction (C) of the recording medium. By changing the arrangement of the exhaust unit 14, the direction (D) of gas flow can be changed as appropriate. In the present embodiment, the gas present between the first head and the recording medium can be made to flow upstream in the conveyance direction of the recording medium, preventing aggregation of the ink.

Third Embodiment

Next, a liquid discharging device according to another embodiment of the present invention is described below.

Descriptions of matters in common with the above embodiment will be omitted.

In the liquid discharging device according to the present embodiment, the housing further internally contains the carriage configured to move in the direction perpendicular to the conveyance direction of the recording medium, the first head and the second head are disposed side by side along the conveyance direction, and the exhaust unit is disposed upstream of the first head in the conveyance direction and adjacent to the first head in the conveyance direction.

Figure 9:
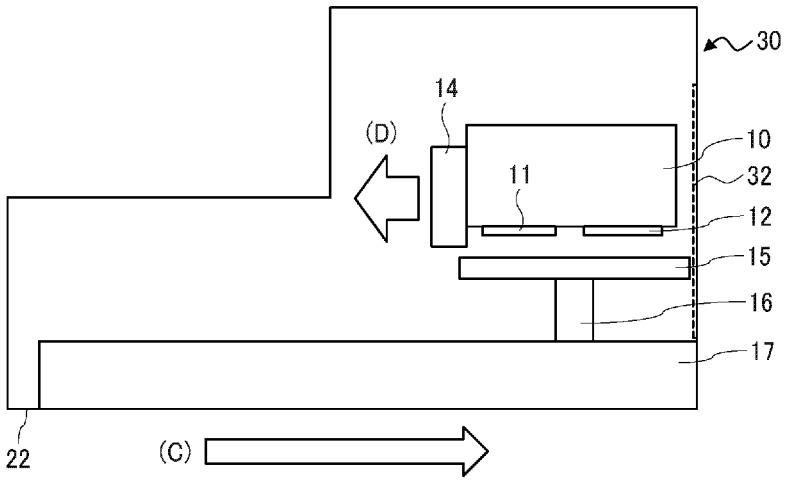
FIG. 9 is a schematic side view of the liquid discharging device according to a third embodiment.

FIG. 9 is a schematic side view of the liquid discharging device according to the present embodiment.

In the present embodiment, as illustrated, the exhaust unit 14 is disposed adjacent to the first head 11 on an upstream side in the conveyance direction of the recording medium. In the present embodiment, the exhaust unit 14 is directly attached to the carriage 10.

As a result, the direction of gas flow is less changeable depending on the position of the carriage 10, exhibiting more stable effects. According to the present embodiment, the gas present between the first head and the recording medium can be made to reliably flow upstream in the conveyance direction of the recording medium, more reliably preventing aggregation of the ink.

In addition, since the distance between the exhaust unit 14 and the head is short, the gas flow can be made with a larger force in the space between the head and the recording medium, thus more reliably preventing the pretreatment liquid from adhering to the second head 12.

Fourth Embodiment

Next, a liquid discharging device according to another embodiment of the present invention is described below.

Descriptions of matters in common with the above embodiment will be omitted.

In the liquid discharging device according to the present embodiment, a plurality of exhaust units is provided, and the total exhaust power of the exhaust units disposed upstream of the first head in the conveyance direction of the recording medium is greater than the total exhaust power of the exhaust units disposed downstream of the first head in the conveyance direction of the recording medium.

Hereinafter, "exhaust power" and "suction power" are described as synonyms.

Figure 10:
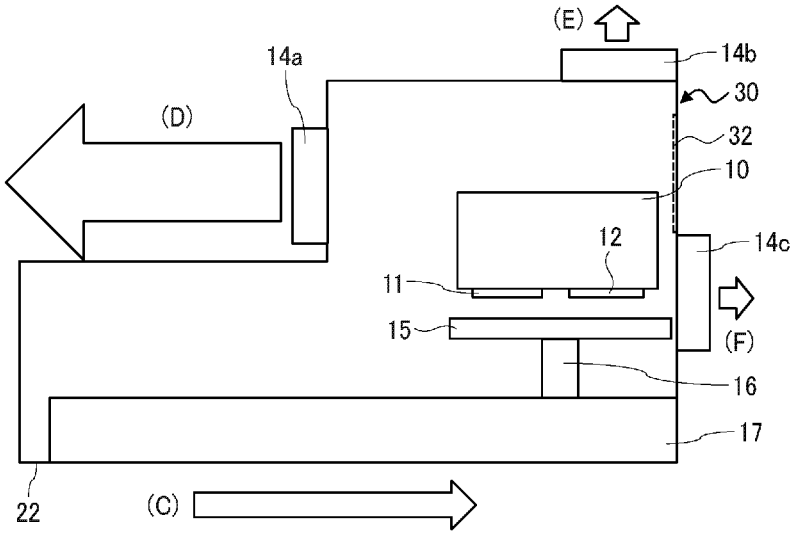
FIG. 10 is a schematic side view of the liquid discharging device according to a fourth embodiment.

FIG. 10 is a schematic side view of the liquid discharging device according to the present embodiment.

As in the present embodiment, the exhaust unit 14 may be disposed downstream of the head in the conveyance direction of the recording medium. In this case, to make the gas present between the head and the recording medium flows in the direction from the second head 12 to the first head 11, an exhaust unit 14*a*, having a larger suction power (flow rate) than other exhaust units 14*b* and 14*c*, may be disposed upstream of the head. Here, as illustrated in FIG. 10, the suction power (D) of the exhaust unit 14*a* is larger than the total suction power ((E)+(F)) of the other exhaust units 14*b* and 14*c*.

By this configuration, the gas present between the first head and the recording medium can be made to flow upstream in the conveyance direction of the recording medium. Thus, mist of the pretreatment liquid hardly reaches the second head 12, preventing aggregation of the ink.

Generally, liquid discharging devices may have various types of fans such as a heat exhaust fan, a cooling fan, and a drying fan, in addition to a mist collection fan. Even in such a case, the effect of reducing aggregation of the ink can be exhibited with the configuration according to the present embodiment.

The "total exhaust power of the exhaust units disposed on the upstream side" described above can be applied to the case in which the number of the exhaust units disposed on the upstream side is only one. The same applies to the exhaust units disposed on the downstream side.

Fifth Embodiment

Next, a liquid discharging device according to another embodiment of the present invention is described below.

Descriptions of matters in common with the above embodiment will be omitted.

Figure 11:
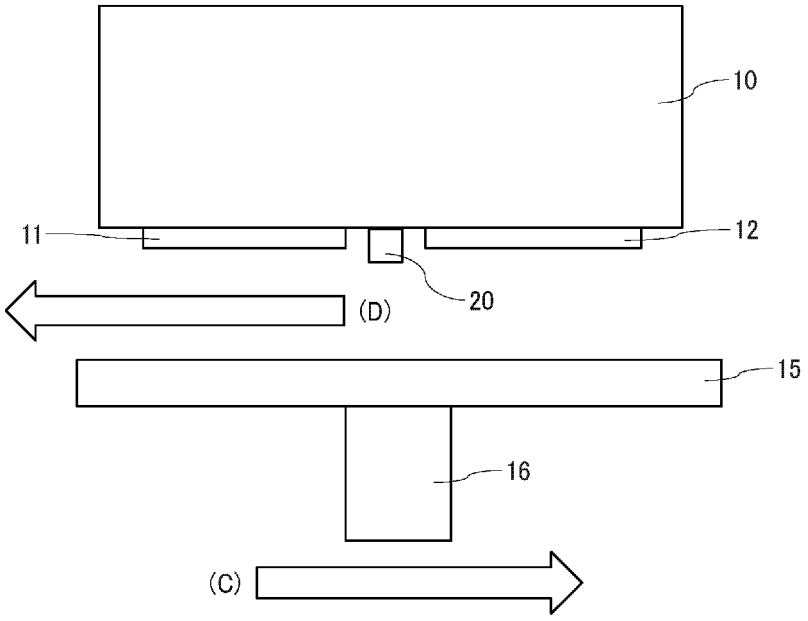
FIG. 11 is a schematic side view of the liquid discharging device according to a fifth embodiment.

FIG. 11 is a schematic side view of the liquid discharging device according to the present embodiment. In FIG. 11, a major part is schematically illustrated.

The liquid discharging device according to the present embodiment has a shield 20 disposed between the first head 11 and the second head 12 in the conveyance direction of the recording medium. Thus, mist of the pretreatment liquid emitted from the first head 11 can be more reliably prevented from reaching the second head 12.

Further, the shield 20 protrudes to the recording medium side from the discharging surface of the first head 11. Since the lower end of the shield 20 protrudes downward from the heads, mist of the pretreatment liquid can be more reliably prevented from reaching the second head 12.

Sixth Embodiment

Next, a liquid discharging device according to another embodiment of the present invention is described below.

Descriptions of matters in common with the above embodiment will be omitted.

The liquid discharging device according to the present embodiment includes a holder configured to hold the recording medium and to move along the conveyance direction of the recording medium. The holder is capable of passing through the opening of the housing and moving to a position protruding from the opening.

Figure 12:
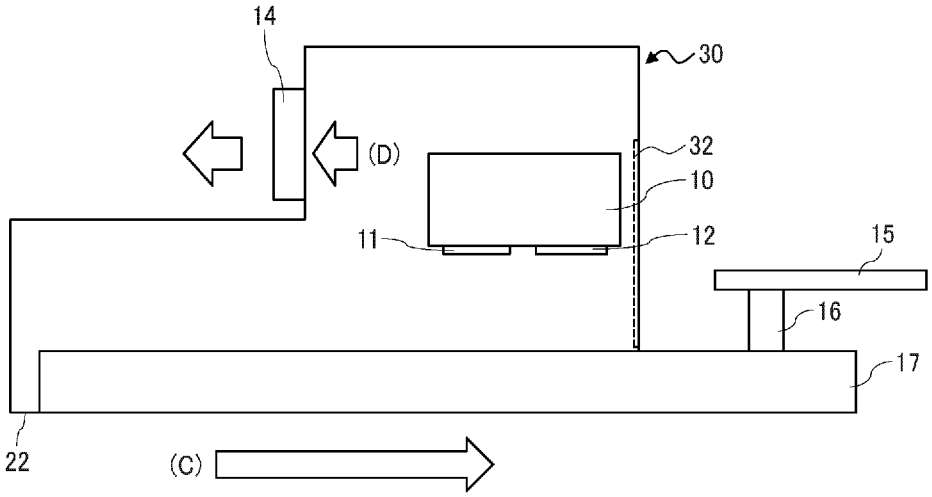
FIG. 12 is a schematic side view of the liquid discharging device according to a sixth embodiment.

FIG. 12 is a schematic side view of the liquid discharging device according to the present embodiment. In FIG. 12, a major part is schematically illustrated. FIG. 12 illustrates a state in which the platen 15 has moved to a position protruding from the opening 32.

In the present embodiment, the platen 15 is illustrated as an example of the holder. Alternatively, the platen 15 and the support 16 may be combined to form the holder.

It is difficult to place the recording medium, such as a T-shirt, on the platen if a part of the head or the housing overlaps the upper part of the platen. For this reason, it is desirable that the platen be configured to move to protrude to the user side beyond the outer wall of the device main body (housing).

In the present embodiment, the platen 15 is capable of passing through the opening 32 and moving to a position protruding from the opening 32, so that the recording medium can be made held by the holder at the outside of the housing. In addition, it is not necessary to secure a space for making the recording medium held on the holder at the inside of the housing, which makes it easier to design the structure of the device.

To allow the platen 15 to pass through the opening 32, for example, the projected area of the opening may be at least larger than the projected area of the platen, as viewed in the conveyance direction of the recording medium.

Pretreatment Liquid

The pretreatment liquid used in the liquid discharging device according to an embodiment of the present invention is not particularly limited and can be appropriately selected from known ones as long as it is dischargeable from the head. Preferably, the pretreatment liquid contains a polyvalent metal ion. The pretreatment liquid may further contain other components, such as a resin, as necessary.

The polyvalent metal ion can be appropriately selected from known ones. Examples thereof include, but are not limited to, calcium ion, magnesium ion, and aluminum ion. Each of these can be used alone or in combination with others.

The polyvalent metal ion can be contained in the pretreatment liquid by dissolving a water-soluble polyvalent metal salt therein.

The polyvalent metal salt can be appropriately selected from known ones. Preferred examples thereof include, but are not limited to, carboxylates (e.g., acetate, lactate), sulfates, nitrates, chlorides, and thiocyanates. Each of these polyvalent metal salts may be used alone or in combination with others. Among these, carboxylates, sulfates, nitrates, and chlorides, which have good solubility in water and water-soluble organic solvents, are preferable for image quality, such as color developing property and bleed resistance, and discharge reliability.

The proportion of the polyvalent metal ion in the pretreatment liquid is preferably from 30 to 700 mmol/L, more preferably from 60 to 500 mmol/L, and most preferably from 100 to 400 mmol/L, for preventing bleeding and uneven density and in view of color developing property, fastness, and adhesiveness.

Ink

Compositional materials of the ink, i.e., an organic solvent, water, a colorant, a resin, and additives, are described in detail below.

Organic Solvent

The organic solvent is not particularly limited and water-soluble organic solvents can be used. Examples thereof include polyols, ethers such as polyol alkyl ethers and polyol aryl ethers, nitrogen-containing heterocyclic compounds, amides, amines, and sulfur-containing compounds.

Specific examples of the water-soluble organic solvents include, but are not limited to, polyols such as ethylene glycol, diethylene glycol, 1,2-propanediol, 1,3-propanediol, 1,2-butanediol, 1,3-butanediol, 1,4-butanediol, 2,3-butanediol, 3-methyl-1,3-butanediol, triethylene glycol, polyethylene glycol, polypropylene glycol, 1,2-pentanediol, 1,3-pentanediol, 1,4-pentanediol, 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butanetriol, 1,2,3-butanetriol, 2,2,4-trimethyl-1,3-pentanediol, and 3-methyl-1,3,5-pentanetriol; polyol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; polyol aryl ethers such as ethylene glycol monophenyl ether and ethylene glycol monobenzyl ether; nitrogen-containing heterocyclic compounds such as 2-pyrrolidone, N-methyl-2-pyrrolidone, N-hydroxyethyl-2-pyrrolidone, 1,3-dimethyl-2-imidazolidinone, ε-caprolactam, and γ-butyrolactone; amides such as formamide, N-methylformamide, N,N-dimethylformamide, 3-methoxy-N,N-dimethyl propionamide, and 3-butoxy-N,N-dimethyl propionamide; amines such as monoethanolamine, diethanolamine, and triethylamine; sulfur-containing compounds such as dimethyl sulfoxide, sulfolane, and thiodiethanol; propylene carbonate; and ethylene carbonate. In particular, organic solvents having a boiling point of 250 degrees C. or less are preferable, since they not only function as wetting agents but also provide good drying property.

In addition, polyol compounds having 8 or more carbon atoms and glycol ether compounds are also preferable. Specific examples of the polyol compounds having 8 or more carbon atoms include, but are not limited to, 2-ethyl-1,3-hexanediol and 2,2,4-trimethyl-1,3-pentanediol.

Specific examples of the glycol ether compounds include, but are not limited to, polyol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; and polyol aryl ethers such as ethylene glycol monophenyl ether and ethylene glycol monobenzyl ether.

The proportion of the organic solvent in the ink is not particularly limited and can be suitably selected to suit to a particular application, but is preferably from 10% to 60% by mass, more preferably from 20% to 60% by mass, for drying property and discharge reliability of the ink.

Water

The proportion of water in the ink is not particularly limited and can be suitably selected to suit to a particular application, but is preferably from 10% to 90% by mass, more preferably from 20% to 60% by mass, for drying property and discharge reliability of the ink.

Colorant

Examples of the colorant include, but are not limited to, pigments and dyes.

Usable pigments include both inorganic pigments and organic pigments. Each of these may be used alone or two or more of these may be used in combination. Mixed crystals can also be used as the colorant.

Usable pigments include black pigments, yellow pigments, magenta pigments, cyan pigments, white pigments, green pigments, orange pigments, glossy color pigments (e.g., gold pigments and silver pigments), and metallic pigments.

Specific examples of inorganic pigments include, but are not limited to, titanium oxide, iron oxide, calcium carbonate, barium sulfate, aluminum hydroxide, barium yellow, cadmium red, chrome yellow, and carbon black produced by a known method such as a contact method, a furnace method, and a thermal method.

Specific examples of organic pigments include, but are not limited to, azo pigments, polycyclic pigments (e.g., phthalocyanine pigments, perylene pigments, perinone pigments, anthraquinone pigments, quinacridone pigments, dioxazine pigments, indigo pigments, thioindigo pigments, isoindolinone pigments, quinophthalone pigments), dye chelates (e.g., basic dye chelate, acid dye chelate), nitro pigments, nitroso pigments, and aniline black. Among these pigments, those having good affinity for solvents are preferable. In addition, hollow resin particles and hollow inorganic particles can also be used.

Specific examples of pigments used for black-and-white printing include, but are not limited to: carbon blacks (i.e., C.I. Pigment Black 7) such as furnace black, lamp black, acetylene black, and channel black; metals such as copper, iron (i.e., C.I. Pigment Black 11), and titanium oxide; and organic pigments such as aniline black (i.e., C.I. Pigment Black 1).

Specific examples of pigments used for color printing include, but are not limited to: C.I. Pigment Yellow 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 138, 150, 153, 155, 180, 185, and 213; C.I. Pigment Orange 5, 13, 16, 17, 36, 43, and 51; C.I. Pigment Red 1, 2, 3, 5, 17, 22, 23, 31, 38, 48:2, 48:2 (Permanent Red 2B (Ca)), 48:3, 48:4, 49:1, 52:2, 53:1, 57:1 (Brilliant Carmine 6B), 60:1, 63:1, 63:2, 64:1, 81, 83, 88, 101 (red iron oxide), 104, 105, 106, 108 (cadmium red), 112, 114, 122 (quinacridone magenta), 123, 146, 149, 166, 168, 170, 172, 177, 178, 179, 184, 185, 190, 193, 202, 207, 208, 209, 213, 219, 224, 254, and 264; C.I. Pigment Violet 1 (rhodamine lake), 3, 5:1, 16, 19, 23, and 38; C.I. Pigment Blue 1, 2, 15 (phthalocyanine blue), 15:1, 15:2, 15:3, 15:4 (phthalocyanine blue), 16, 17:1, 56, 60, and 63; and C.I. Pigment Green 1, 4, 7, 8, 10, 17, 18, and 36.

The dyes are not particularly limited, and acid dyes, direct dyes, reactive dyes, and basic dyes can be used. Each of these can be used alone or in combination with others. Specific examples of the dyes include, but are not limited to, C.I. Acid Yellow 17, 23, 42, 44, 79, and 142, C.I. Acid Red 52, 80, 82, 249, 254, and 289, C.I. Acid Blue 9, 45, and 249, C.I. Acid Black 1, 2, 24, and 94, C. I. Food Black 1 and 2, C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, 171, and 195, C.I. Reactive Red 14, 32, 55, 79, and 249, and C.I. Reactive Black 3, 4, and 35.

The proportion of the colorant in the ink is preferably from 0.1% to 15% by mass, more preferably from 1% to 10% by mass, for improving image density, fixability, and discharge stability.

The pigment can be dispersed in the ink by any of the following methods: introducing a hydrophilic functional group to the pigment to make the pigment self-dispersible; covering the surface of the pigment with a resin; and dispersing the pigment by a dispersant.

In the method of introducing a hydrophilic functional group to the pigment to make the pigment self-dispersible, for example, a functional group such as sulfone group and carboxyl group may be introduced to the pigment (e.g., carbon) to make the pigment dispersible in water.

In the method of covering the surface of the pigment with a resin, for example, the pigment may be incorporated in a microcapsule to make the pigment self-dispersible in water. In this case, the pigment may be referred to as a resin-covered pigment. In this case, not all the pigment particles included in the ink should be covered with a resin. It is possible that a part of the pigment particles is not covered with any resin or partially covered with a resin.

In the method of dispersing the pigment by a dispersant, low-molecular dispersants and high-molecular dispersants, represented by known surfactants, may be used.

More specifically, any of anionic surfactants, cationic surfactants, ampholytic surfactants, and nonionic surfactants may be used as the dispersant depending on the property of the pigment.

For example, a nonionic surfactant RT-100 (available from Takemoto Oil & Fat Co., Ltd.) and sodium naphthalene-sulfonate formalin condensate are preferably used as the dispersant. Each of the above dispersants may be used alone or in combination with others.

Pigment Dispersion

The ink can be obtained by mixing the pigment with other materials such as water and the organic solvent. The ink can also be obtained by, first, preparing a pigment dispersion by mixing the pigment with water, a dispersant, etc., and thereafter mixing the pigment dispersion with other materials such as water and the organic solvent.

The pigment dispersion can be obtained by mixing water, the pigment, a pigment dispersant, and other components, if any, to disperse the pigment, and adjusting the particle diameter of the pigment. Preferably, the dispersing is performed by a disperser.

The particle diameter of the pigment dispersed in the pigment dispersion is not particularly limited, but the number-based maximum frequency particle diameter is preferably in the range of from 20 to 500 nm, more preferably from 20 to 150 nm, for improving dispersion stability of the pigment and discharge stability and image quality (e.g., image density) of the ink. The particle diameter of the pigment can be measured with a particle size analyzer (NANOTRAC WAVE-UT151 available from MicrotracBEL Corp.).

The proportion of the pigment in the pigment dispersion is not particularly limited and can be suitably selected to suit to a particular application, but is preferably from 0.1% to 50% by mass, more preferably from 0.1% to 30% by mass, for improving discharge stability and enhancing image density.

Preferably, the pigment dispersion may be subjected to filtration using a filter or a centrifugal separator to remove coarse particles, followed by degassing.

Resin

The type of the resin contained in the ink is not particularly limited and can be suitably selected to suit to a particular application. Specific examples thereof include, but are not limited to, urethane resins, polyester resins, acrylic resins, vinyl acetate resins, styrene resins, butadiene resins, styrene-butadiene resins, vinyl chloride resins, acrylic styrene resins, and acrylic silicone resins.

These resins may be in the form of particles (hereinafter "resin particles"). The resin particles may be dispersed in water as a dispersion medium to become a resin emulsion. The ink can be obtained by mixing the resin emulsion with other materials such as a colorant and an organic solvent. These resin particles are available either synthetically or commercially. The resin particles may include one type or two or more types of resin particles.

The volume average particle diameter of the resin particles is not particularly limited and can be suitably selected to suit to a particular application. Preferably, the volume average particle diameter is from 10 to 1,000 nm, more preferably from 10 to 200 nm, and most preferably from 10 to 100 nm, to obtain good fixability and high image hardness.

The volume average particle diameter can be measured with a particle size analyzer (NANOTRAC WAVE-UT151 available from MicrotracBEL Corp.).

The proportion of the resin is not particularly limited and can be suitably selected to suit to a particular application. Preferably, the proportion of the resin in the ink is from 1% to 30% by mass, more preferably from 5% to 20% by mass, for fixability and storage stability of the ink.

The particle diameter of solid contents in the ink is not particularly limited and can be suitably selected to suit to a particular application, but the number-based maximum frequency particle diameter is preferably in the range of from 20 to 1,000 nm, more preferably from 20 to 150 nm, for improving discharge stability and image quality (e.g., image density). The solid contents include the resin particles and pigment particles. The particle diameter can be measured with a particle size analyzer (NANOTRAC WAVE-UT151 available from MicrotracBEL Corp.).

Additives

The ink may further contain a surfactant, a defoamer, a preservative, a fungicide, a corrosion inhibitor, and/or a pH adjuster.

Surfactant

Usable surfactants include silicone-based surfactants, fluorine-based surfactants, ampholytic surfactants, nonionic surfactants, and anionic surfactants.

The silicone-based surfactants are not particularly limited and can be suitably selected to suit to a particular application. Preferred are silicone-based surfactants which are not decomposed even in a high pH environment. Specific examples thereof include, but are not limited to, side-chain-modified polydimethylsiloxane, both-end-modified polydimethylsiloxane, one-end-modified polydimethylsiloxane, and sidechain-both-end-modified polydimethylsiloxane. In particular, those having a polyoxyethylene group and/or a polyoxyethylene polyoxypropylene group as the modifying group are preferable because they demonstrate good characteristics as an aqueous surfactant. Specific examples of the silicone-based surfactants further include polyether-modified silicone-based surfactants, such as a dimethyl siloxane compound having a polyalkylene oxide structure on a side chain which is bound to Si.

Specific preferred examples of the fluorine-based surfactants include, but are not limited to, perfluoroalkyl sulfonic acid compounds, perfluoroalkyl carboxylic acid compounds, perfluoroalkyl phosphate compounds, perfluoroalkyl ethylene oxide adducts, and polyoxyalkylene ether polymer compounds having a perfluoroalkyl ether group on its side chain, each of which have weak foaming property. Specific examples of the perfluoroalkyl sulfonic acid compounds include, but are not limited to, perfluoroalkyl sulfonic acid and perfluoroalkyl sulfonate. Specific examples of the perfluoroalkyl carboxylic acid compounds include, but are not limited to, perfluoroalkyl carboxylic acid and perfluoroalkyl carboxylate. Specific examples of the polyoxyalkylene ether polymer compounds having a perfluoroalkyl ether group on a side chain include, but are not limited to, a sulfate of a polyoxyalkylene ether polymer having a perfluoroalkyl ether group on its side chain, and a salt of a polyoxyalkylene ether polymer having a perfluoroalkyl ether group on its side chain. Specific examples of the counter ions for these fluorine-based surfactants include, but are not limited to, Li, Na, K, $NH_4$, $NH_3CH_2CH_2OH$, $NH_2(CH_2CH_2OH)_2$, and $NH(CH_2CH_2OH)_3$.

Specific examples of the ampholytic surfactants include, but are not limited to, laurylaminopropionate, lauryl dimethyl betaine, stearyl dimethyl betaine, and lauryl hydroxyethyl betaine.

Specific examples of the nonionic surfactants include, but are not limited to, polyoxyethylene alkyl phenyl ethers, polyoxyethylene alkyl esters, polyoxyethylene alkyl amines, polyoxyethylene alkyl amides, polyoxyethylene propylene block polymers, sorbitan fatty acid esters, polyoxyethylene sorbitan fatty acid esters, and ethylene oxide adducts of acetylene alcohol.

Specific examples of the anionic surfactants include, but are not limited to, acetate, dodecylbenzene sulfonate, and laurate of polyoxyethylene alkyl ether, and polyoxyethylene alkyl ether sulfate.

Each of these compounds can be used alone or in combination with others.

The silicone-based surfactants are not particularly limited and can be suitably selected to suit to a particular application. Specific examples thereof include, but are not limited to, side-chain-modified polydimethylsiloxane, both-end-modified polydimethylsiloxane, one-end-modified polydimethylsiloxane, and sidechain-and-both-end-modified polydimethylsiloxane. More specifically, polyether-modified silicone-based surfactants having polyoxyethylene group and/or polyoxyethylene polyoxypropylene group as the modifying groups are preferable since they exhibit good properties as an aqueous surfactant.

These surfactants are available either synthetically or commercially. Commercial products are readily available from, for example, BYK Japan KK, Shin-Etsu Chemical Co., Ltd., Dow Corning Toray Co., Ltd., Nihon Emulsion Co., Ltd., and Kyoeisha Chemical Co., Ltd.

The polyether-modified silicone-based surfactants are not particularly limited and can be suitably selected to suit to a particular application. Examples thereof include, but are not limited to, a compound represented by the following general formula (S-1) that is a dimethylpolysiloxane having a polyalkylene oxide structure on its side chain bound to Si atom.

[Chem. 1]

GENERAL FORMULA (S-1)

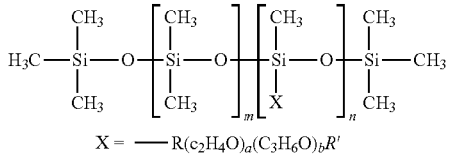

In the general formula (S-1), each of m, n, a, and b independently represents an integer, R represents an alkylene group, and R' represents an alkyl group.

Specific examples of commercially-available polyether-modified silicone-based surfactants include, but are not limited to: KF-618, KF-642, and KF-643 (available from Shin-Etsu Chemical Co., Ltd.); EMALEX-SS-5602 and SS-1906EX (available from Nihon Emulsion Co., Ltd.); FZ-2105, FZ-2118, FZ-2154, FZ-2161, FZ-2162, FZ2163, and FZ-2164 (available from Dow Corning Toray Co., Ltd); BYK-33 and BYK387 (available from BYK Japan KK); and TSF4440, TSF4452, and TSF4453 (available from Momentive Performance Materials Inc.).

Preferably, the fluorine-based surfactant is a compound having 2 to 16 fluorine-substituted carbon atoms, more preferably a compound having 4 to 16 fluorine-substituted carbon atoms.

Specific examples of the fluorine-based surfactants include, but are not limited to, perfluoroalkyl phosphate compounds, perfluoroalkyl ethylene oxide adducts, and polyoxyalkylene ether polymer compounds having a perfluoroalkyl ether group on its side chain. Among these, polyoxyalkylene ether polymer compounds having a perfluoroalkyl ether group on its side chain are preferable since foaming property thereof is small. More specifically, compounds represented by the following general formula (F-1) or (F-2) are preferable as fluorine-based surfactants.

[Chem. 2]

$$CH_3CF_2(CF_2CF_2)_m—CH_2CH_2O(CH_2CH_2O)_nH \quad \text{GENERAL FORMULA (F-1)}$$

In the general formula (F-1), m preferably represents an integer of from 0 to 10, and n preferably represents an integer of from 0 to 40, to give water-solubility to the compound.

$$C_nF_{2n+1}—CH_2CH(OH)CH_2—O—(CH_2CH_2O)_n—Y \quad \text{GENERAL FORMULA (F-2)}$$

In the general formula (F-2), Y represents H, $C_mF_{2m+1}$ (where m represents an integer of from 1 to 6), $CH_2CH$ $(OH)CH_2—C_mF_{2m+1}$ (where m represents an integer of from 4 to 6), or $C_pH_{2p+1}$ (where p represents an integer of from 1 to 19); n represents an integer of from 1 to 6; and a represents an integer of from 4 to 14.

The fluorine-based surfactants are available either synthetically or commercially.

Specific examples of commercially-available fluorine-based surfactants include, but are not limited to: SURFLON S-111, S-112, S-113, S-121, S-131, S-132, S-141, and S-145 (available from Asahi Glass Co., Ltd.); Fluorad™ FC-93, FC-95, FC-98, FC-129, FC-135, FC-170C, FC-430, and FC-431 (available from 3M Japan Limited; MEGAFACE F-470, F-1405, and F-474 (available from DIC Corporation); Zonyl (registered trademark) TBS, FSP, FSA, FSN-100, FSN, FSO-100, FSO, FS-300, UR, CAPSTONE FS-30, FS-31, FS-3100, FS-34, and FS-35 (available from The Chemours Company); FT-110, FT-250, FT-251, FT-4005, FT-150, and FT-400SW (available from NEOS COMPANY LIMITED); PolyFox PF-136A, PF-156A, PF-151N, PF-154, and PF-159 (available from OMNOVA Solutions Inc.); and UNIDYNE™ DSN-403N (available from Daikin Industries, Ltd.). Among these, for improving printing quality, in particular color developing property, paper permeability, paper wettability, and uniform dying property, FS-3100, FS-34, and FS-300 (available from The Chemours Company), FT-110, FT-250, FT-251, FT-4005, FT-150, and FT-400SW (available from NEOS COMPANY LIMITED), PolyFox PF-151N (available from OMNOVA Solutions Inc.), and UNIDYNE™ DSN-403N (available from Daikin Industries, Ltd.) are particularly preferred.

The proportion of the surfactant in the ink is not particularly limited and can be suitably selected to suit to a particular application, but is preferably from 0.001% to 5% by mass, more preferably from 0.05% to 5% by mass, for improving wettability and discharge stability and enhancing image quality.

Defoamer

Specific examples of the defoamer include, but are not limited to, silicone defoamers, polyether defoamers, and fatty acid ester defoamers. Each of these can be used alone or in combination with others. Among these defoamers, silicone defoamers are preferable since they have excellent defoaming ability.

Preservative and Fungicide

Specific examples of the preservative and fungicide include, but are not limited to, 1,2-benzisothiazoline-3-one.

Corrosion Inhibitor

Specific examples of the corrosion inhibitor include, but are not limited to, acid sulphite and sodium thiosulfate.

pH Adjuster

The pH adjuster is not particularly limited as long as it is capable of adjusting the pH to 7 or higher. Specific examples thereof include, but are not limited to, amines such as diethanolamine and triethanolamine.

The properties of the ink, such as viscosity, surface tension, and pH, are not particularly limited and can be suitably selected to suit to a particular application.

Preferably, the ink has a viscosity of from 5 to 30 mPa·s, more preferably from 5 to 25 mPa·s, at 25 degrees C., for improving print density and text quality and enhancing dischargibility. The viscosity can be measured at 25 degrees C. by a rotatory viscometer (RE-80L available from Toki Sangyo Co., Ltd.) equipped with a standard cone rotor (1°34'×R24), while setting the sample liquid amount to 1.2 mL, the number of rotations to 50 rotations per minute (rpm), and the measuring time to 3 minutes.

Preferably, the ink has a surface tension of 35 mN/m or less, more preferably 32 mN/m or less, at 25 degrees C., so that the ink is suitably levelized on a recording medium and the drying time of the ink is shortened.

Preferably, the ink has a pH of from 7 to 12, more preferably from 8 to 11, for preventing corrosion of metal materials contacting the ink.

Aftertreatment Liquid

The aftertreatment liquid is not particularly limited as long as it is capable of forming a transparent layer. The aftertreatment liquid may be prepared by mixing an organic solvent, water, a resin, a surfactant, a defoamer, a pH adjuster, a preservative, a fungicide, and/or a corrosion inhibitor. The aftertreatment liquid can be applied to the entire recording area on a recording medium or only the printed area where an ink image has been formed.

Recording Medium

The recording medium is not particularly limited. For example, plain paper, gloss paper, special paper, and cloth can be used. Also, impermeable substrates can be used to form good quality images.

The impermeable substrate refers to a substrate having a surface with a low level of moisture permeability and absorptivity. Examples thereof include a material having a number of hollow spaces inside but not open to the exterior. To be more quantitative, the impermeable substrate refers to a substrate that absorbs water in an amount of 10 $mL/m^2$ or less from the start of contact to 30 $msec^{1/2}$ after the start of contact, when measured according to the Bristow method. Specific preferred examples of the impermeable substrate include, but are not limited to, plastic films such as vinyl chloride resin films, polyethylene terephthalate (PET) films, polypropylene films, polyethylene films, and polycarbonate films.

The recording medium is not limited to articles used as typical recording media. Examples of articles usable as the recording medium include: building materials such as wall paper, floor material, and tile; cloth for apparel such as T-shirt; textile; and leather. In addition, by adjusting the configuration of paths through which the recording medium is conveyed, ceramics, glass, and metals may be used as the recording medium.

EXAMPLES

Further understanding can be obtained by reference to certain specific examples which are provided herein for the purpose of illustration only and are not intended to be limiting. In the following descriptions, "parts" represent "parts by mass" unless otherwise specified.

Synthesis of Monomer (1)

First, 24.8 g (210 mmol) of 1,6-hexanediol (available from Tokyo Chemical Industry Co., Ltd.) was dissolved in 280 mL of methylene chloride, and 8.3 g (105 mmol) of pyridine was further added thereto.

Another solution in which 20.0 g (105 mmol) of 2-naphthalenecarbonyl chloride (available from Tokyo Chemical Industry Co., Ltd.) was dissolved in 40 mL of methylene chloride was added dropwise to the above-prepared solution over a period of 2 hours while stirring the solution, followed by stirring at room temperature for 6 hours. After the resulting reaction liquid was washed with water, the organic phase was isolated and dried with magnesium sulfate, and the solvent was evaporated. The residue was purified by silica gel column chromatography using a mixed solvent of methylene chloride/methanol (volume ratio: 98/2) as the eluent, thus obtaining 21.0 g of a reaction intermediate (I-1) represented by the following structural formula (I-1).

[Chem. 3]

STRUCTURAL FORMULA (I-1)

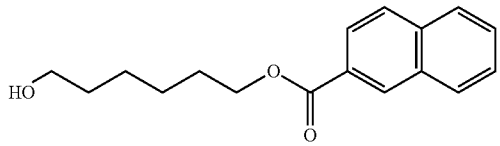

Next, 16.8 g (62 mmol) of the reaction intermediate (I-1) was dissolved in 20 mL of dry methyl ethyl ketone and heated to 60 degrees C. Another solution in which 9.6 g (62 mmol) of 2-methacryloyloxyethyl isocyanate (KARENZ MOI available from Showa Denko K.K.) was dissolved in 20 mL of dry methyl ethyl ketone was added dropwise to the above-prepared solution over a period of 1 hour while stirring, followed by stirring at 70 degrees C. for 12 hours. The resulting liquid was cooled to room temperature and the solvent was distilled away. The residue was purified by silica gel column chromatography using a mixed solvent of methylene chloride/methanol (volume ratio: 99/1) as the eluent, thus obtaining 22.8 g of a monomer (1) represented by the following structural formula.

[Chem. 4]

MONOMER (1)

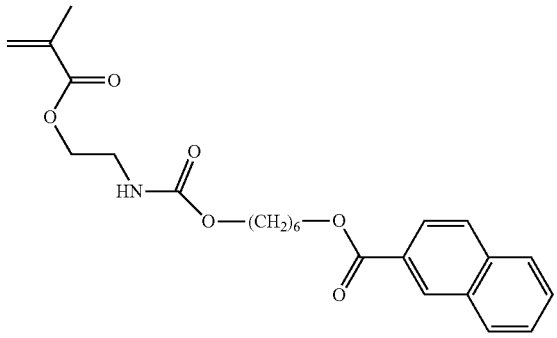

Synthesis of Copolymer 1

First, a monomer solution was prepared by dissolving 1.80 g (25.0 mmol) of acrylic acid (available from by Aldrich) and 8.51 g (25.0 mmol) of the monomer (1) in 16 mL of dry methyl ethyl ketone. Next, 10% of the monomer solution was heated to 75 degrees C. under argon gas flow. To this heated monomer solution, another solution in which 0.410 g (2.50 mmol) of 2,2'-azoiso(butyronitrile) (available from Tokyo Chemical Industry Co., Ltd.) was dissolved in the rest of the monomer solution was added dropwise over a period of 1.5 hours, followed by stirring at 75 degrees C. for 6 hours. The resulting reaction liquid was cooled to room temperature and poured in hexane. The deposited copolymer was filtered and dried under reduced pressures, thus obtaining 12.2 g of a copolymer 1 (having a weight average molecular weight (Mw) of 9,400).

Preparation of Black Pigment Dispersion

The below-listed materials were premixed and subject to a circulation dispersion treatment for 7 hours using a disk-type bead mill (KDL available from Shinmaru Enterprises Corporation, filled with zirconia ball media having a diameter of 0.3 mm). Thus, a black pigment dispersion (having a pigment concentration of 15% by mass) was prepared.

Carbon black pigment (NIPEX 90 available from orion Engineered Carbons): 15 parts Copolymer 1:2 parts Ion-exchange water: 83 parts Production of Resin Particle Dispersion Liquid 1

A resin particle dispersion liquid 1 was prepared by the following procedure.

A 300-mL flask equipped with a stirrer, a thermometer, a nitrogen gas introducing tube, and a condenser was charged with 87.0 parts of ion-exchange water, then heated to 70 degrees C. and maintained for 2 hours. On the other hand, an emulsion was prepared by mixing 30.0 parts of methyl methacrylate, 52.0 parts of 2-ethylhexyl acrylate, 8 parts of PME-1000 (methoxypolyethylene glycol methacrylate, available from NOF CORPORATION), 5 parts of vinyl triethoxysilane, 1.5 parts of AKUARON HS-10 (available from DKS Co., Ltd.), and 43 parts of ion-exchange water by a HOMOMIXER.

Subsequently, 3.0 parts of a 10% aqueous solution of AKUARON HS-10 and 2.6 parts of a 5% aqueous solution of ammonium persulfate were added to the flask, and then the emulsion was continuously dropped therein over a period of 2.5 hours. Further, 0.5 parts of a 5% aqueous solution of ammonium persulfate was dropped therein every one hour until three hours had lapsed from the start of dropwise addition. After completion of the dropwise addition, the flask contents were aged at 70 degrees C. for 2 hours and then cooled to room temperature, the pH was adjusted to 7 to 8 with 28% ammonia water, and the solid content concentration was adjusted to 30% with ion-exchange water. Thus, a resin particle dispersion liquid 1 was prepared.

Production of Resin Particle Dispersion Liquid 2

A resin particle dispersion liquid 2 was prepared by the following procedure.

First, a 500-mL separable flask equipped with a stirrer, a thermometer, and a condenser was charged with 74 parts of T5651 (polycarbonate diol, available from Asahi Kasei Corporation), 10 parts of dimethylol propionic acid, 50 parts of hydrogenated MDI (methylene diphenyl diisocyanate), and 90 parts of acetone dehydrated with a molecular sieve, and heated to 70 degrees C. under nitrogen gas flow. Next, 200 ppm of tin 2-ethylhexanoate was added thereto and reacted at 70 degrees C. for 3 to 10 hours while measuring the isocyanate concentration in the system. Next, the temperature in the system was lowered to 40 degrees C., 8 parts of triethylamine was added, and 270 parts of ion-exchange water was then added while stirring at 300 rpm, followed by stirring for 1 hour. Next, 3 parts of diethylenetriamine was added and stirred for 3 to 6 hours. The flask contents were then cooled to room temperature, the solvent was distilled off by an evaporator, and the solid content concentration was adjusted to 30% with ion-exchange water. Thus, a resin particle dispersion liquid 2 was prepared.

Preparation of Pretreatment Liquid

The following materials were mixed and stirred for one hour and pressure-filtered with a 1.2 μm cellulose acetate membrane filter, thus preparing a pretreatment liquid. An amount of ion-exchange water was added so as to adjust the total amount to 100 parts.

Propylene glycol: 20 parts

3-Methoxy-3-methyl-1-butanol: 10 parts

WET 270 (available from Evonik Industries AG): 0.5 parts

BYK 348 (available from BYK Japan KK): 0.5 parts
EnviroGem (registered trademark) AD01 (available from Air Products and Chemicals, Inc.): 0.5 parts
PROXEL LV: 0.3 parts
Magnesium chloride hexahydrate: 5 parts
Resin particle dispersion liquid 1:25 parts Preparation of Black Ink The following materials were mixed and stirred for one hour and pressure-filtered with a 1.2-μm cellulose acetate membrane filter, thus preparing a black ink. An amount of ion-exchange water was added so as to adjust the total amount to 100 parts.

Propylene glycol: 20 parts
Triethylene glycol: 5 parts
WET 270 (available from Evonik Industries AG): 0.5 parts
BYK 348 (available from BYK Japan KK): 0.5 parts
EnviroGem (registered trademark) AD01 (available from Air Products and Chemicals, Inc.): 0.5 parts
PROXEL LV: 0.3 parts
Black pigment dispersion: 33 parts
Resin particle dispersion liquid 2:30 parts

Examples 1 to 5 and Comparative Example 1

In Examples 1 to 5, each of the liquid discharging devices according to the above-described first to fifth embodiments was filled with the pretreatment liquid and the black ink. As Comparative Example 1, the liquid discharging device illustrated in FIGS. 13 and 14 was filled with the pretreatment liquid and the black ink.

In each Example or Comparative Example, the following evaluations were performed.

Continuous Discharge Reliability

In each Example or Comparative Example, the pretreatment liquid and the black ink were continuously discharged up to 8 hours in an environment having a temperature of 40 degrees C. and a relative humidity of 20%, and the time until stable discharge of droplets of the black ink from nozzles was terminated was measured. Based on the measured time, continuous discharge reliability was evaluated based on the following evaluation criteria.

Evaluation Criteria

A+: Even after 3 hours from the start of discharge, neither misfiring nor discharge failure was observed even once.

A: Even after 1 hour from the start of discharge, neither misfiring nor discharge failure was observed even once.

B: Misfiring or discharge failure was observed after 30 minutes or more and less than 1 hour from the start of discharge.

C: Misfiring or discharge failure was observed after less than 30 minutes from the start of discharge.

Evaluation of Image Density on Plastic Film

In each Example or Comparative Example, the pretreatment liquid was uniformly applied at a deposition amount of 0.5 mg/cm$^2$ to a corona-treated surface of a PYLEN (registered trademark) film P2111 (available from TOYOBO CO., LTD.) having a thickness of 20 μm. The black ink was then applied at a deposition amount of 1.0 mg/cm$^2$ while the surface remained undried, thus forming a solid image. The solid image was dried for 1 minute in a hot-air circulating constant temperature bath set at 100 degrees C. to obtain an evaluation image for each Example or comparative Example. The evaluation image was measured with an x-rite eXact to evaluate optical density (OD) of the image.

Evaluation Criteria

A: OD is 2.4 or more
B: OD is 2.0 or more and less than 2.4
C: OD is less than 2.0

Color Developing Property on Fabric

In each Example or Comparative Example, the pretreatment liquid was uniformly applied at a deposition amount of 0.5 mg/cm$^2$ to a polyester T-shirt (glimmer 00300-ACT, white) available from TOMS CO., LTD. The black ink was then applied at a deposition amount of 1.5 mg/cm$^2$ while the surface remained undried, thus forming a solid image. The solid image was dried for 1 minute by a heat press set at 160 degrees C. to obtain an evaluation image for each Example or comparative Example.

The evaluation image was measured with an x-rite eXact to evaluate optical density (OD) of the image.

Evaluation Criteria

A: OD is 1.3 or more
B: OD is 1.2 or more and less than 1.3
C: OD is less than 1.2

The evaluation results are presented in Table 1.

TABLE 1

| | | Continuous Discharge Reliability | Image Density on Plastic Film | Color Developing Property on Fabric |
|---|---|---|---|---|
| Example 1 | 1st Embodiment | A | A | A |
| Example 2 | 2nd Embodiment | A | A | A |
| Example 3 | 3rd Embodiment | A+ | A | A |
| Example 4 | 4th Embodiment | A | B | A |
| Example 5 | 5th Embodiment | A+ | A | A |
| Comparative Example 1 | FIGS. 13 and 14 | C | C | C |

In Example 3, continuous discharge reliability is evaluated as "A+" because the distance between the exhaust unit and the head is short due to provision of the exhaust unit to the carriage, thereby preventing the pretreatment liquid from adhering to the second head.

In Example 5, continuous discharge reliability is evaluated as "A+" because the pretreatment liquid is prevented from adhering to the second head due to provision of the shield.

In Comparative Example 1, mist of the pretreatment liquid adheres to the second head to cause aggregation of the ink, and discharge reliability, image density, and color developing property are all poor.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

This patent application is based on and claims priority pursuant to Japanese Patent Application Nos. 2018-164323 and 2019-107142, filed on Sep. 3, 2018 and Jun. 7, 2019, in the Japan Patent Office, the entire disclosure of each of which is hereby incorporated by reference herein.

REFERENCE SIGNS LIST

10 Carriage
11 First head
12 Second head
13 Carriage scanning rail
14 Exhaust unit
15 Platen

16 Support
17 Platen moving table
18 Maintenance unit
19 Platen moving rail
20 Shield
22 Device main body
30 Housing
32 Opening

The invention claimed is:

1. A liquid discharging structure, comprising:

a first head containing a pretreatment liquid to discharge onto a recording medium;

a second head disposed downstream of the first head in a conveyance direction of the recording medium to discharge an ink;

an exhaust structure disposed upstream of the first head in the conveyance direction to evacuate a gas present between the first head and the recording medium from a downstream side to an upstream side in the conveyance direction;

a housing internally containing the first head and the second head, internally or externally containing the exhaust structure, and having an opening downstream of the exhaust structure in the conveyance directions;

a maintenance structure including a suction pump to perform maintenance of the first head and the second head, wherein when the first head and the second head are positioned above the maintenance structure, the second head, the first head, and the exhaust structure are arranged in this order, from a side of the opening, in an overlapping manner in the conveyance direction.

2. The liquid discharging structure according to claim 1, wherein the exhaust structure comprises a plurality of exhaust structures devices each disposed upstream of the first head in the conveyance direction.

3. The liquid discharging structure according to claim 1, wherein the housing further internally contains the carriage, wherein the first head and the second head are disposed side by side along the conveyance direction, wherein the exhaust structure is adjacent to the first head in the conveyance direction.

4. The liquid discharging structure according to claim 1, wherein the exhaust structure comprises a plurality of exhaust structures, wherein a total exhaust power of a first plurality of the exhaust structures disposed upstream of the first head in the conveyance direction is greater than a total exhaust power of a second plurality of the exhaust structures disposed downstream of the first head in the conveyance direction.

5. The liquid discharging structure according to claim 1, further comprising:

a holder to hold the recording medium and to move along the conveyance direction, the holder capable of passing through the opening and moving to a position protruding from the opening.

6. The liquid discharging structure according to claim 1, wherein the exhaust structure comprises a fan.

7. The liquid discharging structure according to claim 1, further comprising a shield disposed between the first head and the second head in the conveyance direction.

8. The liquid discharging structure according to claim 7, wherein the shield protrudes to a side of the recording medium from a discharging surface of the first head.

9. The liquid discharging structure according to claim 1, wherein the pretreatment liquid contains a polyvalent metal ion.

10. The liquid discharging device according to claim 1, further comprising:

a carriage carrying the first head and the second head, the carriage configured to move in a direction perpendicular to the conveyance direction.

* * * * *